US006688911B2

(12) United States Patent
Fuerst et al.

(10) Patent No.: US 6,688,911 B2
(45) Date of Patent: Feb. 10, 2004

(54) ELECTRICAL CONNECTOR ASSEMBLY FOR FLAT FLEXIBLE CIRCUITRY

(75) Inventors: Robert M. Fuerst, West Bloomfield, MI (US); Yves LePottier, Grosse Pointe, MI (US)

(73) Assignee: Molex Incorporated, Lisle, IL (US)

( * ) Notice: Subject to any disclaimer, the term of this patent is extended or adjusted under 35 U.S.C. 154(b) by 71 days.

(21) Appl. No.: 09/737,265

(22) Filed: Dec. 13, 2000

(65) Prior Publication Data

US 2002/0072271 A1 Jun. 13, 2002

(51) Int. Cl.[7] ..... H01R 9/07
(52) U.S. Cl. ..... 439/496; 439/632
(58) Field of Search ..... 439/496, 67, 499, 439/495, 492, 656, 77, 660, 494, 498, 176, 326, 493, 631, 632, 65, 74, 78.1, 329, 698

(56) References Cited

U.S. PATENT DOCUMENTS

| | | | | |
|---|---|---|---|---|
| 3,082,398 A | | 3/1963 | Valach | 339/176 |
| 3,114,587 A | | 12/1963 | Herrmann | 339/75 |
| 3,602,870 A | | 8/1971 | Willard | 339/17 |
| 3,825,878 A | | 7/1974 | Finger et al. | 339/17 |
| 3,924,915 A | | 12/1975 | Conrad | 339/17 |
| 4,581,495 A | | 4/1986 | Geri et al. | 179/179 |
| 4,802,866 A | | 2/1989 | Balzano et al. | 439/496 |
| 4,921,437 A | * | 5/1990 | Cooper et al. | 439/275 |
| 4,971,575 A | * | 11/1990 | Martellotti | 439/496 |
| 4,973,264 A | * | 11/1990 | Kamono et al. | 439/498 |
| 5,111,362 A | | 5/1992 | Flamm et al. | 361/395 |
| 5,297,968 A | * | 3/1994 | Johnson et al. | 439/67 |
| 5,383,788 A | | 1/1995 | Spencer | 439/67 |
| 5,470,246 A | | 11/1995 | Mosquera | 439/260 |
| 5,529,502 A | | 6/1996 | Peltier et al. | 439/67 |
| 6,039,600 A | | 3/2000 | Etters et al. | 439/496 |
| 6,234,820 B1 | * | 5/2001 | Perino et al. | 439/326 |

* cited by examiner

*Primary Examiner*—Renee Luebke
*Assistant Examiner*—Phuongchi Nguyen
(74) *Attorney, Agent, or Firm*—Stacey E. Caldwell

(57) ABSTRACT

A connector assembly is provided for removably interconnecting first conductors of a flat flexible circuit to a plurality of second conductors without the use of conductive terminals. The assembly includes a male connector having a relatively rigid male body member with an edge about which the flexible circuit is wrapped, and with the first conductors of the circuit facing away from the body member at the edge thereof. An adapter or other female connecting device includes a first receptacle for receiving the male connector inserted edge-first into the first receptacle. A second receptacle receives the second conductors in position for engaging the first conductors of the flexible circuit at the edge of the male body member.

10 Claims, 8 Drawing Sheets

ELECTRICAL CONNECTOR ASSEMBLY FOR FLAT FLEXIBLE CIRCUITRY

FIELD OF THE INVENTION

This invention generally relates to the art of electrical connectors and, particularly, to connectors for electrically interconnecting flat flexible circuitry.

BACKGROUND OF THE INVENTION

A flat flexible circuit conventionally includes an elongated flat flexible dielectric substrate having laterally spaced strips or conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board, discrete electrical wires or the terminals of a mating connector.

A wide variety of connectors have been designed over the years for terminating or interconnecting flat flexible circuits with complementary mating connecting devices. Major problems continued to plague such connectors, particularly in the area of cost and reliability. Not only is the direct material costs of such connectors unduly high, but an undue amount of labor time is required in assembling such connectors. These problems have been solved by providing simple, inexpensive and reliable connector structures which do not use conductive terminals, such as those shown in U.S. Pat. Nos. 6,039,600 and 6,077,124 which are assigned to the assignee of the present invention.

The connector structures shown in the above-identified patents and other prior art use various forms of body members about which a flat flexible circuit is wrapped, with the conductors of the circuit facing away from the body member. Typically, the body member is generally flat or planar, and the conductors of the flat flexible circuit are biased into engagement with mating conductors in a direction generally perpendicular to the plane of the body member. This type of system requires structure which increases the thickness of the body member in order to resist deflection of normal load to effect the perpendicular connection. There is a need for such connectors for flat flexible circuitry which are relatively thin or provide a low profile, and the present invention is directed to satisfying that need and solving the problem of excessive thickness in connectors for flat flexible circuitry.

SUMMARY OF THE INVENTION

An object, therefore, of the invention is to provide a new and improved connector assembly for flat flexible circuitry.

In the exemplary embodiment of the invention, the connector assembly is provided for interconnecting first conductors of a flat flexible circuit to a plurality of second conductors without the use of conductive terminals. The assembly includes a male connector having a relatively rigid male body member with an edge about which the flexible circuit is wrapped, with the first conductors of the circuit facing away from the body member at the edge. A female connecting device includes a receptacle for receiving the male connector inserted into the receptacle. Means are provided on the device for positioning the second conductors in engagement with the first conductors of the flexible circuit at the edge of the male body member.

According to one aspect of the invention, the female connecting device comprises an adapter including the receptacle for receiving the male connector inserted edge-first into the receptacle. The adapter includes a second receptacle for receiving the second conductors in position for engaging the first conductors of the flexible circuit at the edge of the male body member.

According to another aspect of the invention, the male body member includes a forward part having the edge about which the flexible circuit is wrapped, and a rearward part latched to the adapter. A spring is disposed between the forward and rearward parts to bias the forward part and, thereby, the first conductors of the flexible circuit against the second conductors.

As disclosed herein, a relatively yieldable backing structure is provided on the male body member at the edge thereof beneath the flexible circuit for resiliently biasing the first conductors of the circuit against the second conductors. The male body member is elongated and the yieldable backing structure comprises a longitudinal resilient strip along the edge of the body member. Positioning means also are provided on the male body member for locating the flexible circuit wrapped about the edge of the body member. In the preferred embodiment, the positioning means comprises an adhesive between the body member and the flexible circuit adhering the flexible circuit thereto.

The invention also contemplates a combination which includes a printed circuit board inserted into the second receptacle of the adapter, with the printed circuit board having the second conductors engageable with the first conductors of the flexible circuit. Another contemplated combination includes the provision of a second flat flexible circuit inserted into the second receptacle of the adapter. The second flexible circuit has the second conductors engageable with the first conductors. A further combination contemplated by the invention includes a plurality of discrete electrical wires inserted into the second receptacle of the adapter. The discrete electrical wires have the second conductors engageable with the first conductors of the flexible circuit.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
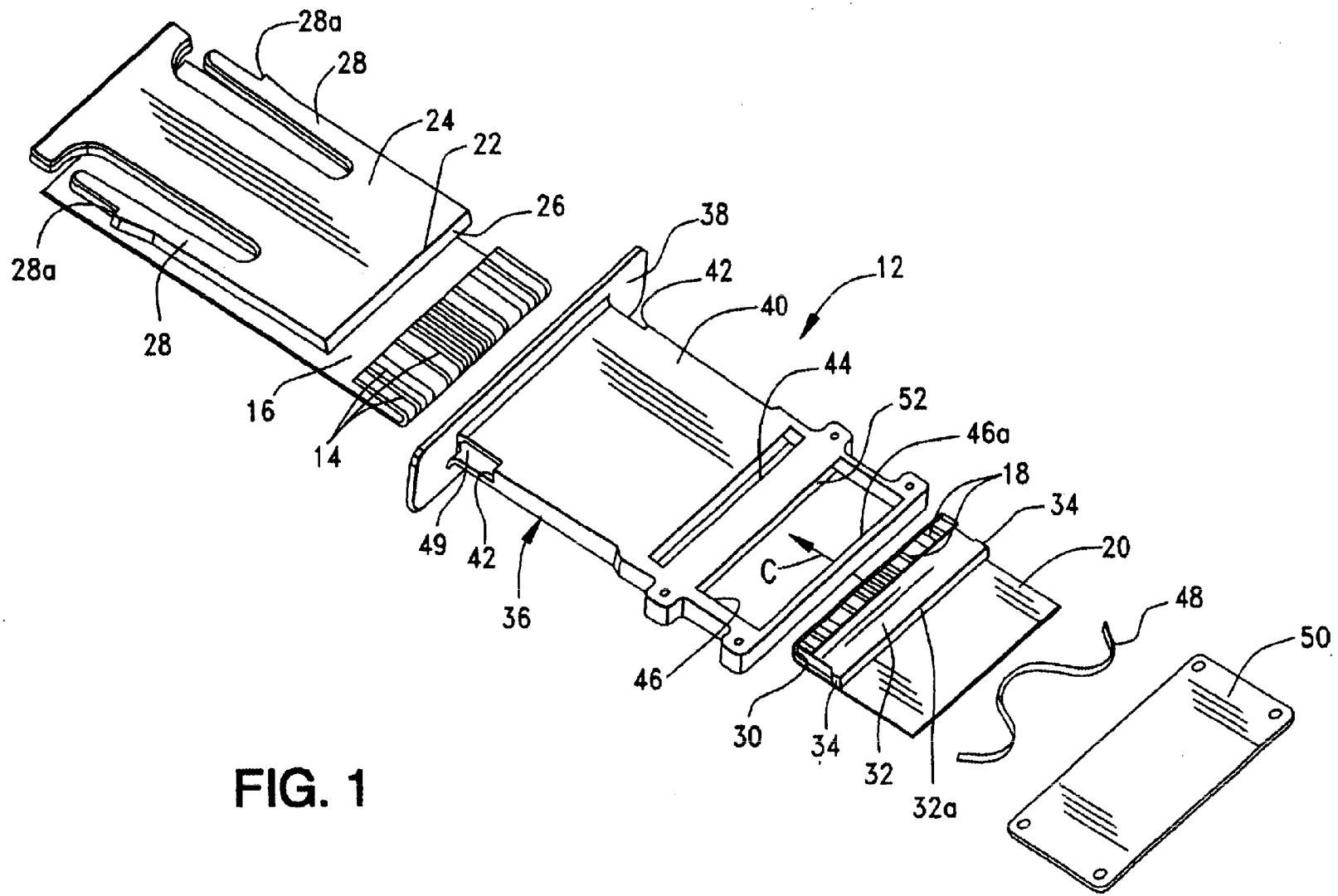
FIG. 1 is an exploded perspective view of a first embodiment of a connector assembly according to the invention, for interconnecting a pair of flat flexible circuits.
Figure 2:
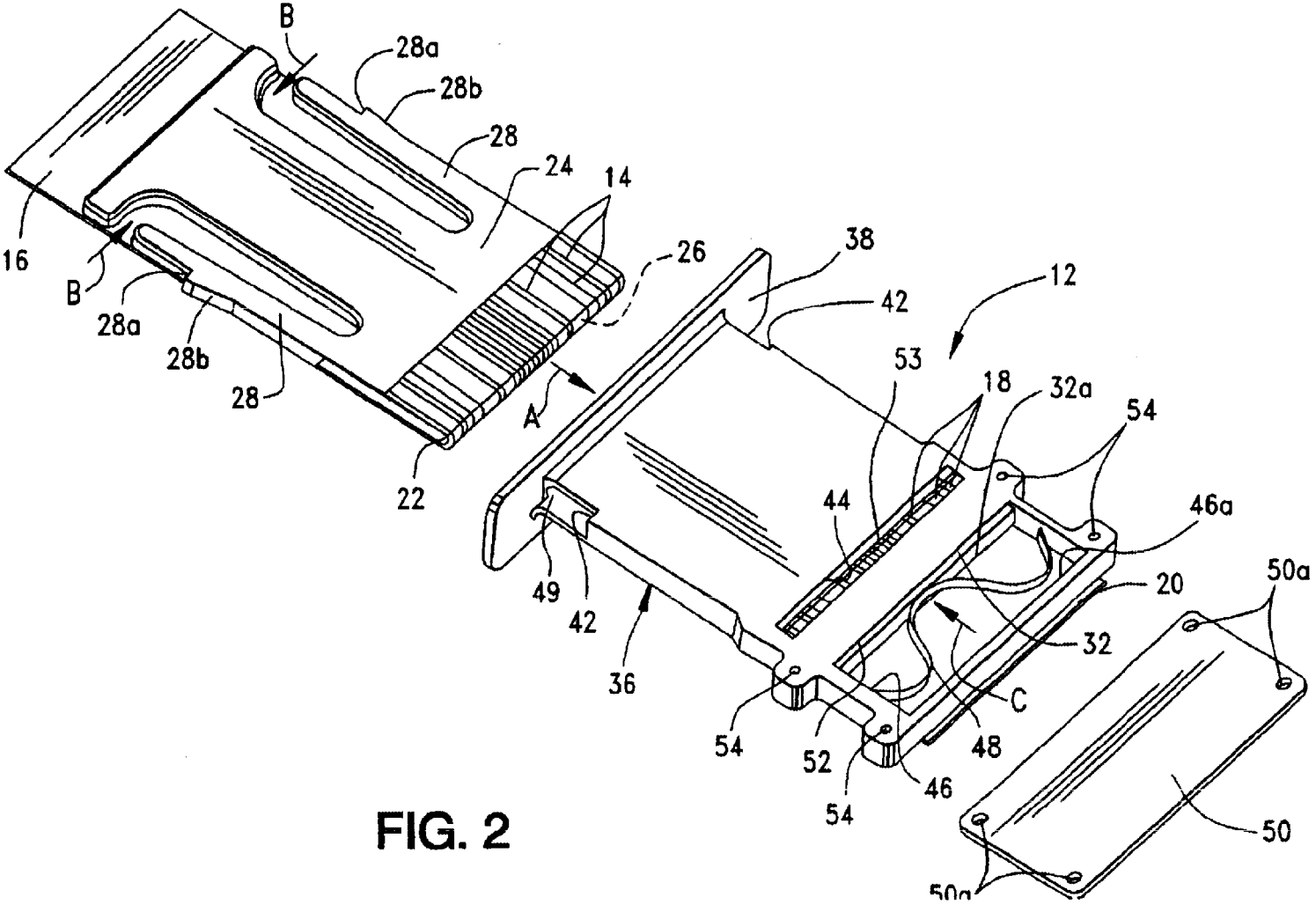
FIG. 2 is an exploded perspective view similar to that of FIG. 1, with the assembly partially assembled.
Figure 3:
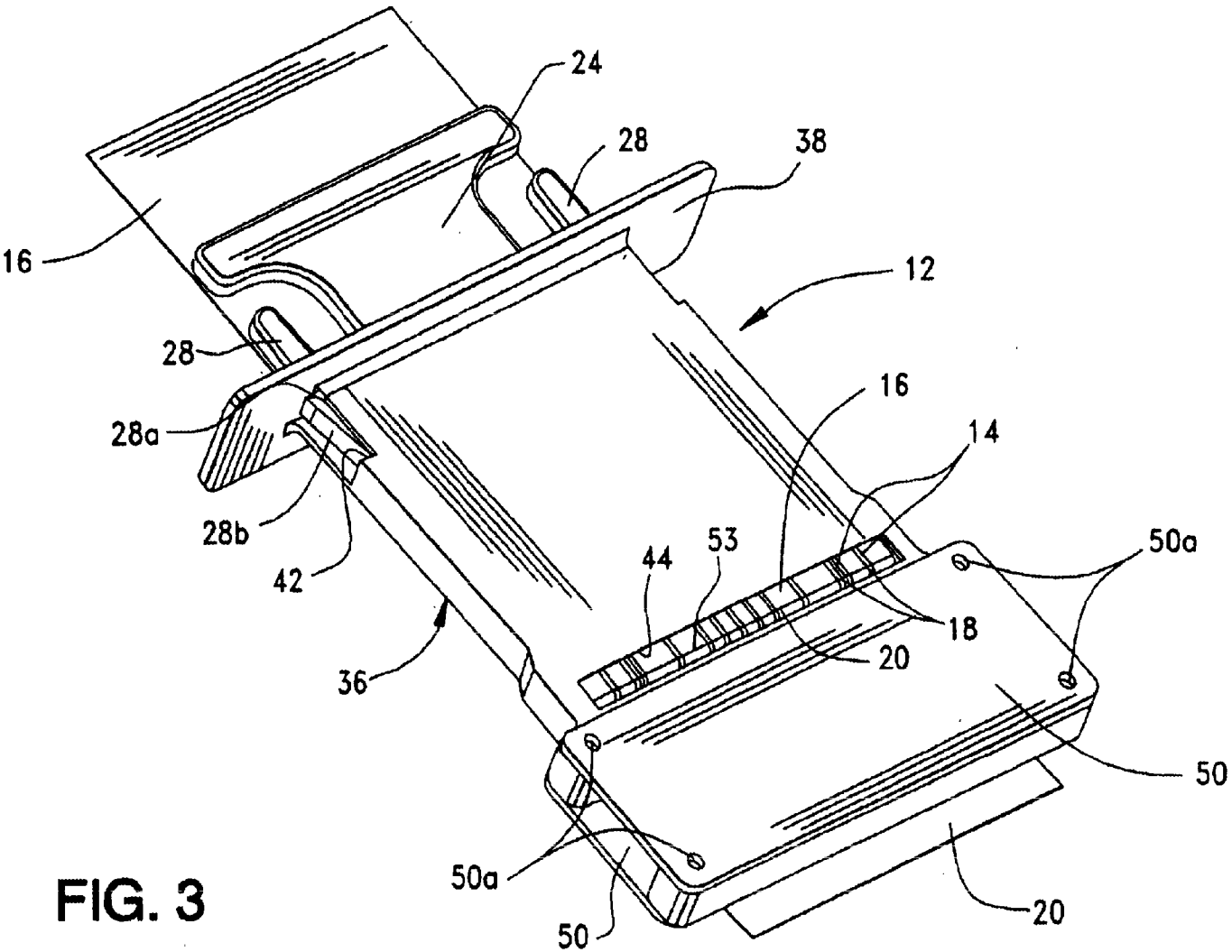
FIG. 3 is a perspective view of the embodiment of FIGS. 1 and 2, in assembled mated condition.

Referring to the drawings in greater detail, and first to FIGS. 1–3, a first embodiment of a connector assembly, generally designated 12, is designed for removably interconnecting a plurality of first conductors 14 of a first flat flexible circuit 16 to a plurality of second conductors 18 of a second flat flexible circuit 20 without the use of conductive terminals. First flexible circuit 16 is wrapped about an edge 22 of a first, relatively rigid male body member 24, with first conductors 14 of the circuit facing away from the body member at the edge. Male body member 24 is a thin, flat or generally planar structure. Edge 22 is elongated, and a yieldable backing structure in the form of a longitudinal resilient strip 26 is adhered to the body member along the edge. Male body member 24 may be molded of dielectric material such as plastic or the like, and a pair of flexible latch arms 28 are cantilevered along opposite sides of the body member. Each latch arm has an outwardly directed latch hook 28*a*.

Second flat flexible circuit 20 is wrapped about an edge 30 of a second male body member 32, with second conductors 18 of the circuit facing away from the body member at edge 30. The second male body member is flat or generally planar, of dielectric material and includes a pair of outwardly projecting latch bosses 34.

First flexible circuit 16 about first male body member 24 is interconnected with second flexible circuit 20 about second male body member 32 within a female connecting device in the form of an adapter, generally designated 36. As can be seen, the adapter is generally flat or planar. The adapter includes a front flange 38 and a generally hollow body 40. The body includes a pair of side windows 42, a narrow top window or slit 44 and a larger rear window 46. For purposes described hereinafter, an undulated spring 48 is provided for biasing second male body member 32 and second flexible circuit 20 toward first male body member 24 and first flexible circuit 16. A cover plate 50 is provided for covering the spring. A second or bottom cover plate (not shown) may be provided at the bottom of the housing.

FIG. 2 shows first flat flexible circuit 16 wrapped around edge 22 of first male body member 24, with first conductors 14 of the circuit facing away from the first body member at the edge. The circuit is wrapped around resilient strip 26 which is effective to bias first conductors 14 toward second conductors 18 of second flexible circuit 20. Flexible circuit 16 is held and located in wrapped condition about male body member 24 by a positioning means in the form of an adhesive applied to opposite faces of the body member in areas appropriate for adherence to the flexible circuit. It is contemplated by the invention that the adhesive could be applied alternatively to the flexible circuit, the result being that the adhesive joins the body member and the flex circuit. By using the adhesive, the overall envelope of the body member can be maintained to be very thin.

The subassembly of first male body member 24 and first flexible circuit 16 is inserted into a first receptacle 49 in adapter 36 in the direction of arrow "A" (FIG. 2). As the subassembly is inserted, chamfered edges 28*b* of flexible latch arms 28 engage the sides of the receptacle to bias the latch arms inwardly in the direction of arrows "B". When the subassembly is fully inserted as shown in FIG. 3, latch hooks 28*a* resiliently snap back outwardly through side windows 42 into engagement with the back side of front flange 38.

The subassembly of second male body member 32 and second flexible circuit 20 is inserted in the direction of arrow "C" into a second receptacle 52 beneath window 46 of adapter 36. Latch bosses 34 interengage with interior latches (not visible in the drawings) within the adapter. Second flexible circuit 20 is positioned and located about edge 30 of second male body member 32 by a positioning means provided by an adhesive as described above in relation to first male body member 24 and first flexible circuit 16. After the subassembly of second male body member 32 and second flexible circuit 20 is inserted into adapter 36 as seen in FIG. 2, undulated spring 48 is positioned through window 46 onto the top of the circuit. The spring is sandwiched between a rear edge 32*a* of second male body member 32 and a rear edge 46*a* of window 46 to bias the body member and conductors 18 of second flexible circuit 20 forwardly in the direction of arrow "C". The combination of spring 48 behind second male body member 32 and resilient strip 26 on edge 22 of first male body member 24 is effective to provide a positive interface 53 (FIG. 3) between conductors 14 of first flexible circuit 16 and conductors 18 of second flexible circuit 20. Finally, cover plate 50 is positioned on top of adapter 36 to close window 46 and capture spring 48 therewithin as seen in FIG. 3. Appropriate fasteners (not shown) are inserted through holes 50*a* in the cover plate and into holes 54 in the adapter.

From the foregoing, it can be understood that conductors 14 and 18 of flat flexible circuits 16 and 20, respectively, are electrically connected at interface 53 in directions "A" and "C" which are generally parallel to flat male body members 24 and 32. This interengagement is generally parallel to the orientations of the flat flexible circuits within the assembly, except where the circuits are wrapped around the mating edges of the male body members. This is in contrast to connecting the conductors of the flat flexible circuits in directions generally perpendicular to the circuits, as is prevalent in the prior art. The result is that a much thinner, low profile assembly is provided. In addition, by using adhesives to position and locate the flat flexible circuits on the male body members, a significantly thinner assembly is afforded and allows the entire flex circuit width to be used for active conductors because there is no need for space occupying locating holes to be formed in the flexible circuit.

Figures 4, 5:
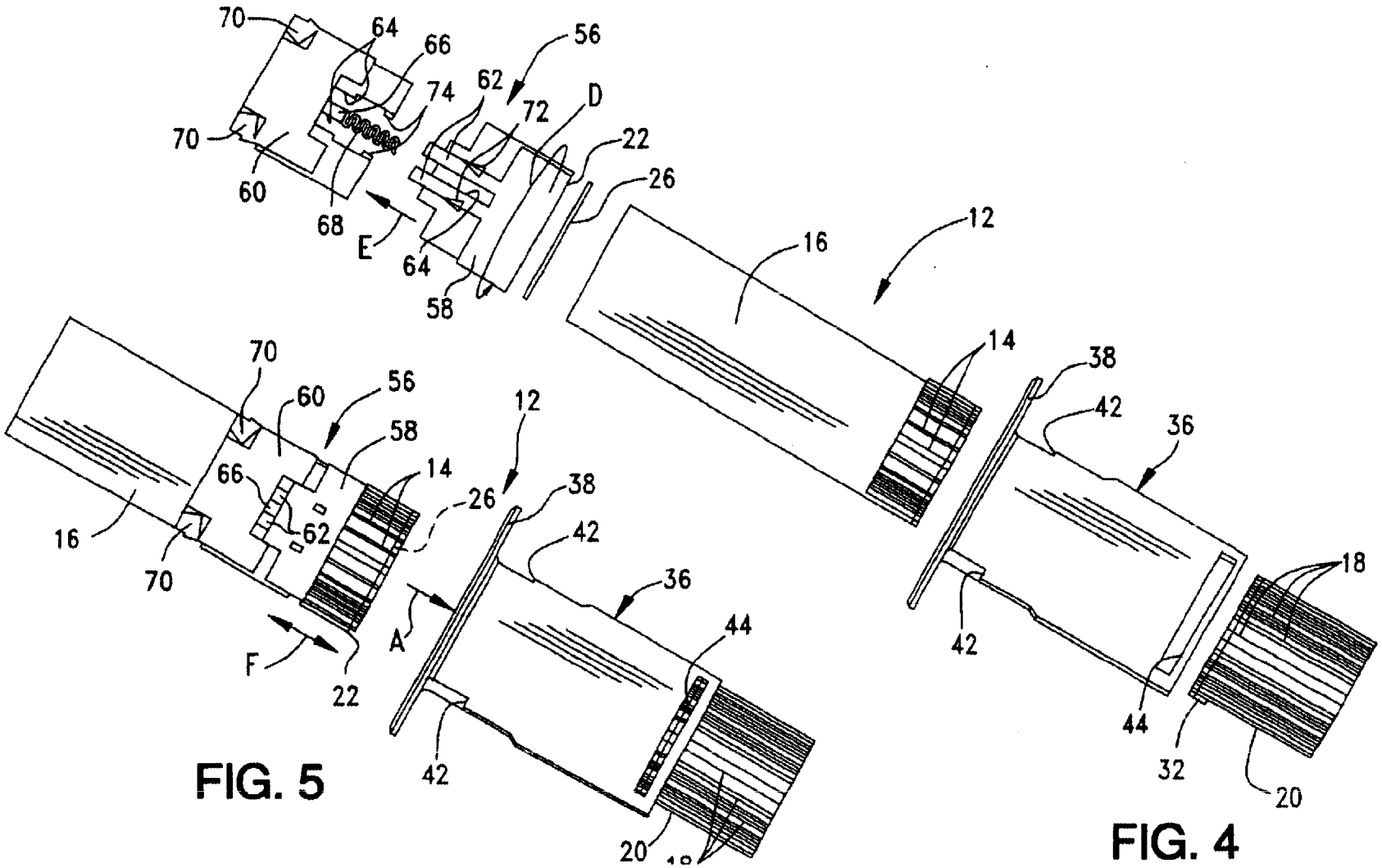
FIG. 4 is an exploded perspective view of a second embodiment of a connector assembly incorporating the concepts of the invention, again for interconnecting a pair of flat flexible circuits.
FIG. 5 is a perspective view of the embodiment of FIG. 4, assembled but in unmated condition.

FIGS. 4 and 5 show a second embodiment of the invention which, like the embodiment of FIGS. 1–3, is designed for interconnecting conductors 14 of a first flat flexible circuit 16 with conductors 18 of a second flat flexible cable 20. The flexible circuits are interconnected through an adapter 36 which is identical to the adapter shown in FIGS. 1–3, except that the window 46 has been removed. The principal difference between the second embodiment of FIGS. 4 and 5 and the first embodiment of FIGS. 1–3, is that the one-piece male body member 24 of the first embodiment has been replaced with a two-part, spring-loaded male body member, generally designated 56. Like reference numerals have been applied in FIGS. 4 and 5 to designate like components described above and shown in FIGS. 1–3.

In particularly, male body member 56 includes relatively rigid, thin flat forward and rearward body parts 58 and 60, respectively. It should be noted that forward body part 58 is shown upside-down in FIG. 4 in order to facilitate the illustration. In assembly, the forward body part will be turned over 180° in the direction of arrow "D" and assembled to rearward body part 60 in the direction of arrow "E". The forward body part has an edge 22 to which a yieldable backing structure or resilient strip 26 is adhered, as in the first embodiment. The forward body part has a pair of ribs 62 defining a groove 64 therebetween. The ribs move into a pair of grooves 64 on rearward body part 60, grooves 64 being separated by a projection 66. A spring 68 is disposed within groove 64 of the forward body part and is sandwiched between the base of groove 64 and the distal end of projection 66 of the rearward body part. A pair of latches 70 are provided at opposite sides of the rear body part. The forward body part includes a pair of latch apertures 72 for receiving a pair of latch bosses 74 on the rear body part.

FIG. 5 shows the two-part male body member 56 in assembled condition with flexible circuit 16 wrapped about the edge of forward body part 58 with conductors 14 facing away from the body member at edge 22. As with the first embodiment, this subassembly is inserted into adapter 36 in the direction of arrow "A" until latches 70 latch behind front flange 38 of the adapter within side windows 42. Latches 72 and 74 of the two parts of the male body member interengage, whereby forward body part 58 can move relative to rearward body part 60 in the direction of double-headed arrow "F". Second flexible circuit 20 has been inserted into the back side of adapter 32 and conductors 18 of the second flexible circuit will engage beneath window 44 at the edges of forward body part 58 of male body member 56 and male body member 32 (FIG. 4) of the second flexible circuit.

Figure 6:
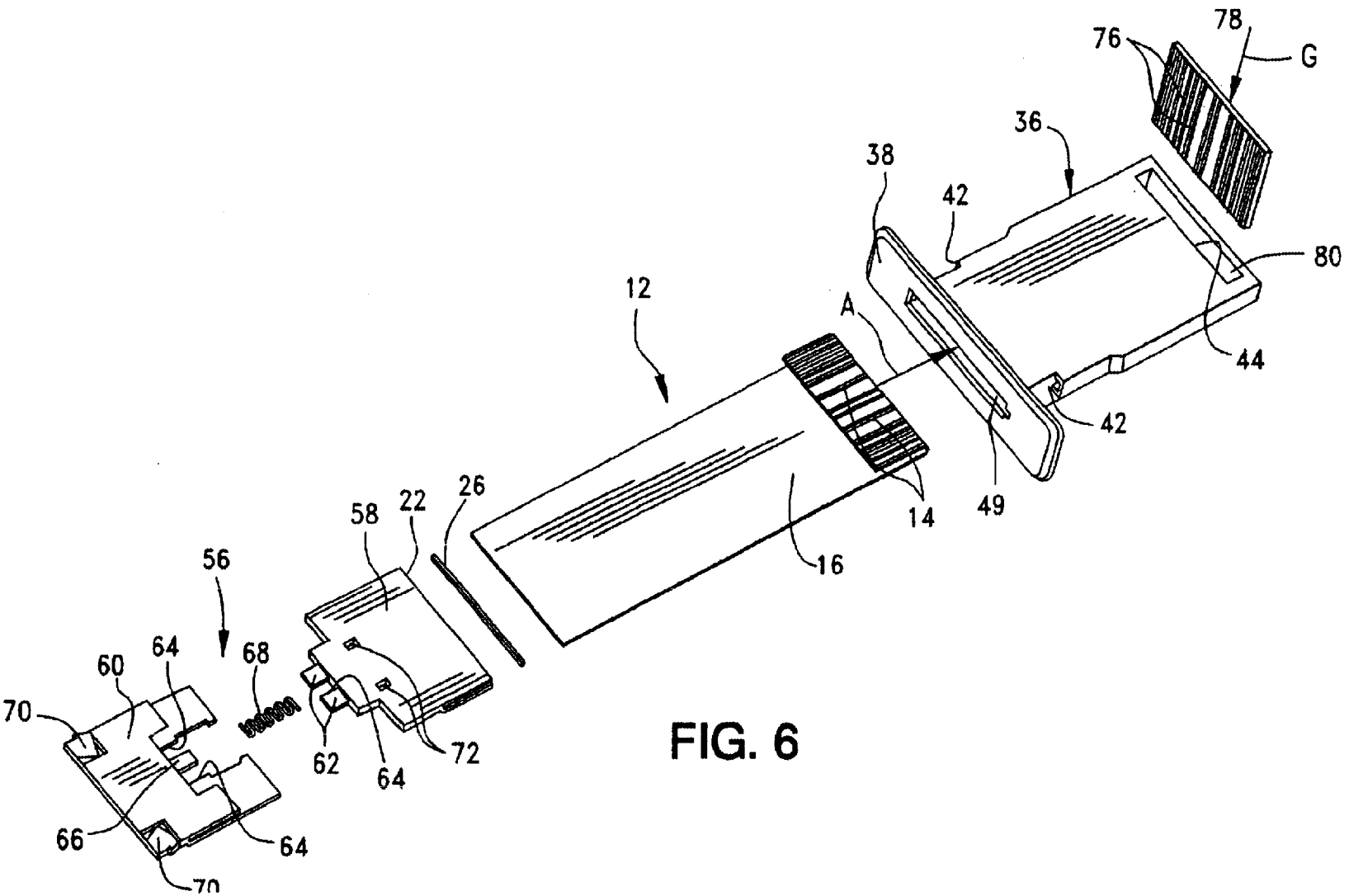
FIG. 6 is an exploded perspective view of a third embodiment of a connector assembly incorporating the concepts of the invention for interconnecting a flat flexible circuit with a printed circuit board.
Figures 7, 8:
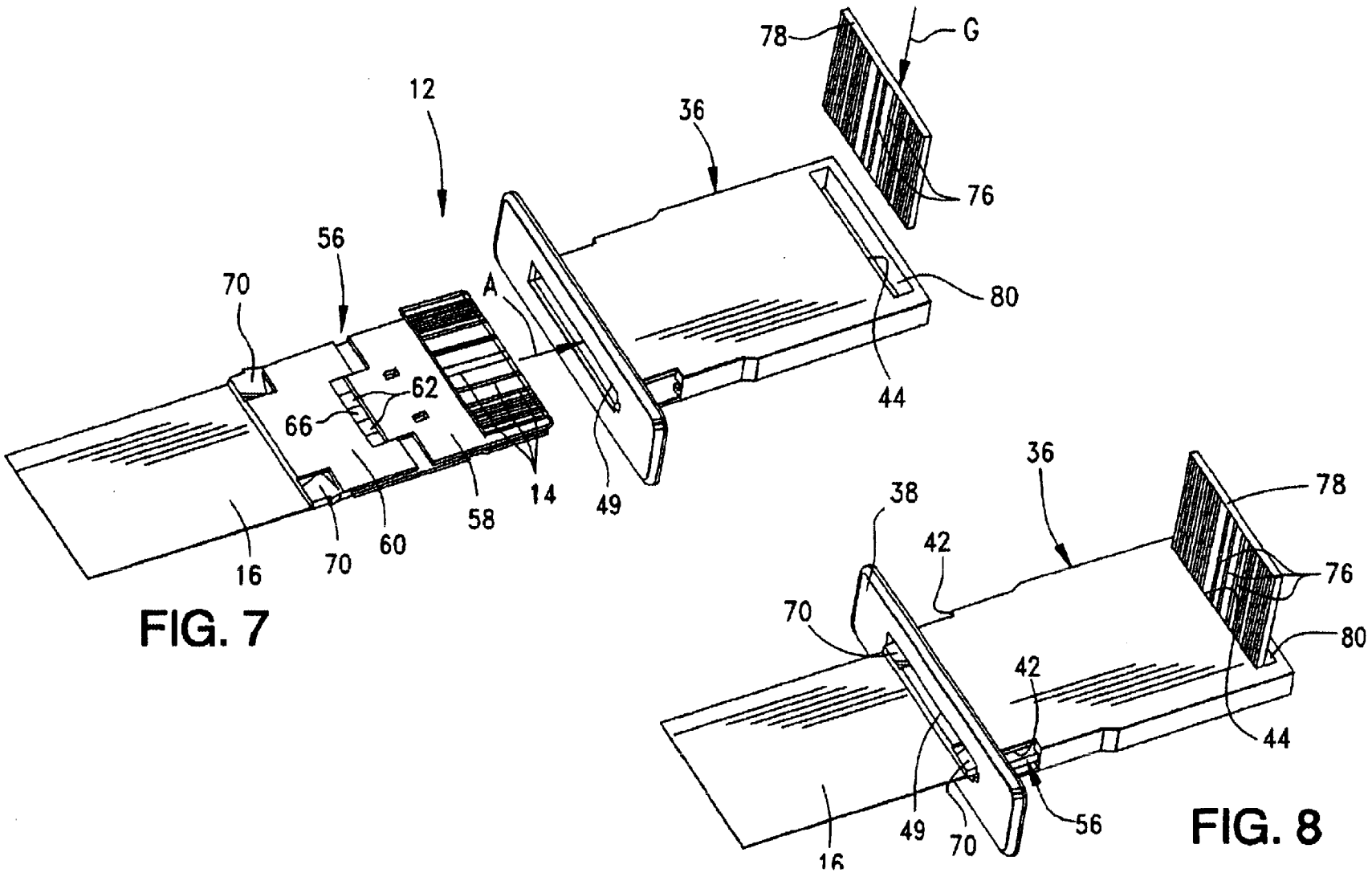
FIG. 7 is a perspective view of the embodiment of FIG. 6, in assembled but unmated condition.
FIG. 8 is a view similar to that of FIG. 7, with the assembly fully mated.

FIGS. 6–8 show a third embodiment of the invention wherein conductors 14 of first flat flexible circuit 16 are interconnected with conductors 76 of a printed circuit board 78. Two-part male body member 56 and adapter 36 are substantially identical to the second embodiment of FIGS. 4 and 5, and the descriptions thereof will not be repeated. Suffice it to say, like numerals have been applied in FIGS. 6 and 7 corresponding to like components described above and shown in FIGS. 4 and 5.

In the embodiment of FIGS. 6–8, the subassembly of male body member 56 and flexible circuit 16 again are inserted into receptacle 48 in adapter 36 in the direction of arrow "A". Printed circuit board 78 is inserted into window 44 in the direction of arrow "G" so that conductors 76 face towards conductors 14 of flexible circuit 16. In this embodiment, window 44 becomes a second receptacle for the adapter for receiving the printed circuit board. Instead of the adapter being open at the back side thereof, an abutment wall 80 is provided to provide support behind the printed circuit board. Receptacle 44 can be dimensioned relative to the printed circuit board to establish a press-fit to hold the printed circuit board in the adapter as seen in FIG. 8.

Figure 9:
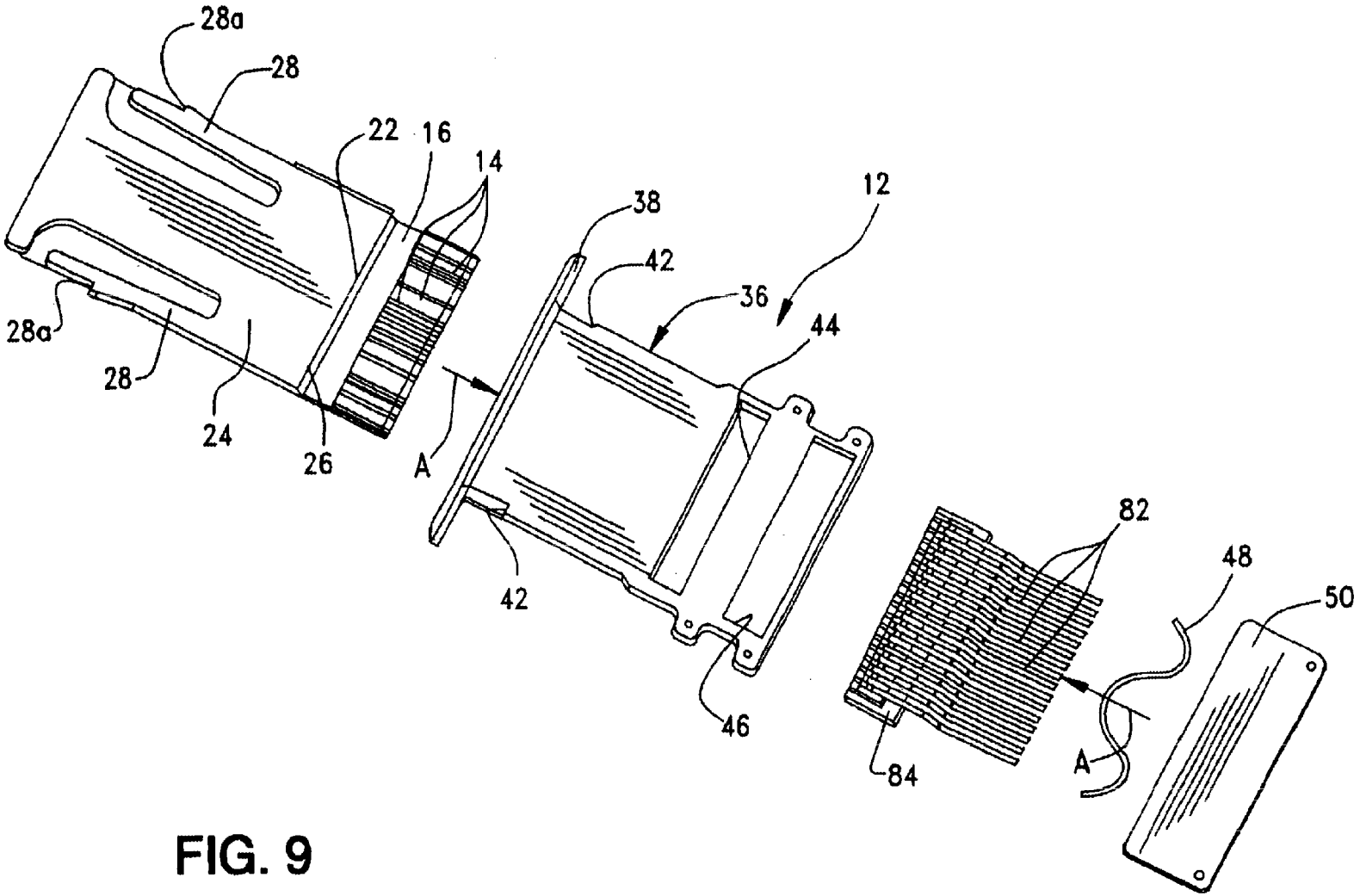
FIG. 9 is an exploded perspective view of a fourth embodiment of a connector assembly incorporating the concepts of the invention, for interconnecting a flat flexible circuit with a plurality of discrete electrical wires.
Figure 10:
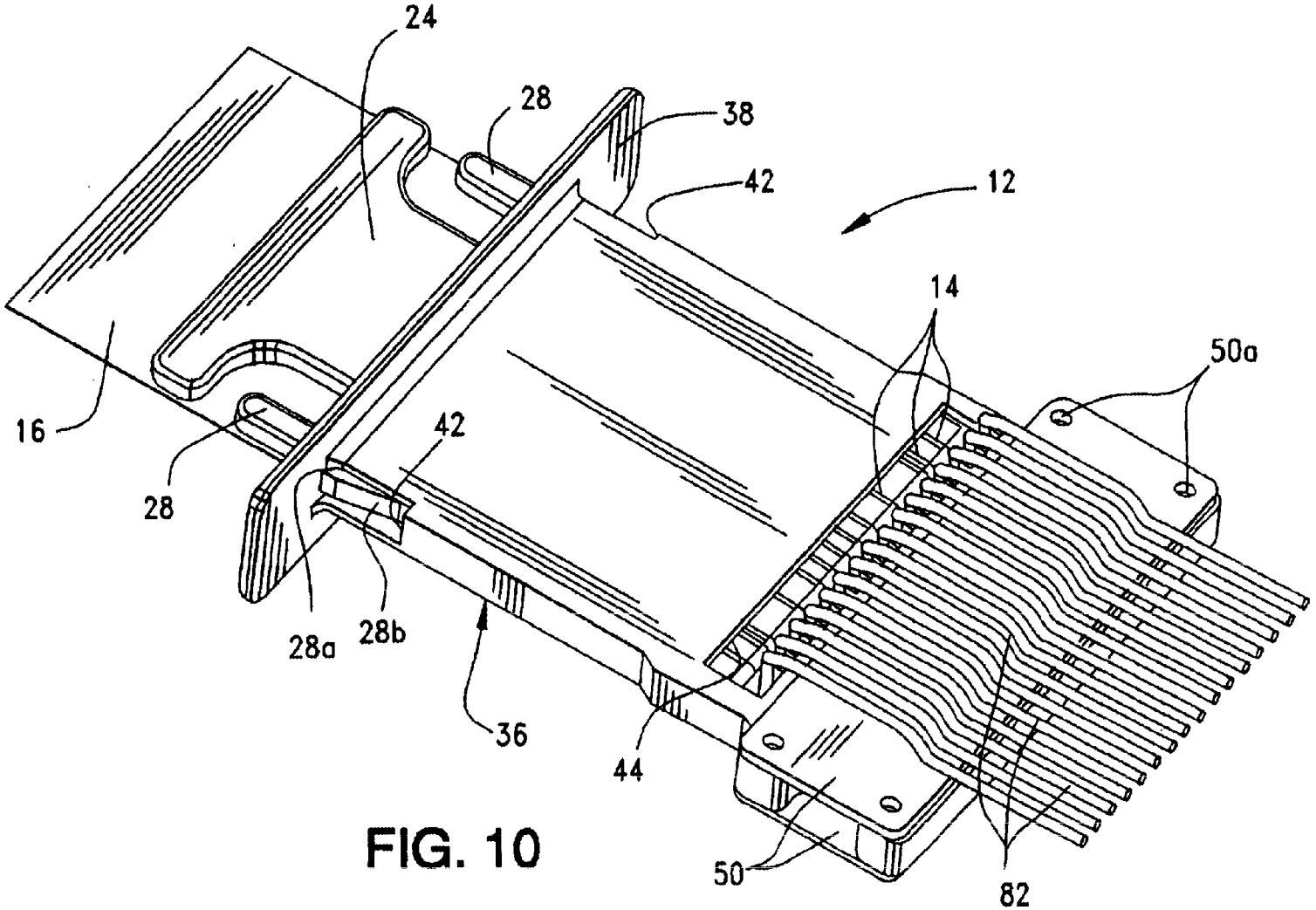
FIG. 10 is a perspective view of the embodiment of FIG. 9, in fully assembled and mated condition.

FIGS. 9 and 10 show a fourth embodiment wherein conductors 14 of flat flexible cable 16 are interconnected with the conductors of a plurality of discrete electrical wires 82. In this embodiment, a relatively rigid male body member 24 and an adapter 36 are used substantially identical to the first embodiment of FIGS. 1–3. Like the first embodiment, an undulated spring 48 is disposed within window 46 and supported by a pair of cover plates 50. The spring engages a tail aligner 84 to bias the tail aligner and electrical wires 82 forward in the direction of arrow "H".

It should be noted that electrical wires 82 are shown assembled to tail aligner 84 in FIG. 9. This is not the actual sequence of assembly. As seen in FIG. 10, electrical wires 82 actually are disposed on top of top cover plate 50. In actual assembly, tail aligner 84 is first mounted within the adapter, the ends of electrical wires 82 are stripped of their insulation to expose the conductors thereof, and the conductors are inserted and crimped to metal terminals (or other means of mechanical or electrical connection) by a press-fit into properly spaced holes in the tail aligner for alignment and engagement with conductors 14 of flat flexible circuit 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A connector assembly for removably interconnecting first conductors of a flat flexible circuit to a plurality of second conductors without the use of conductive terminals, comprising:

a male connector having a two-part relatively rigid male body member including a flat forward body part having an edge about which the flexible circuit is wrapped with the first conductors of the circuit facing away from the forward body part at the edge thereof, a relatively yieldable backing structure on the forward body part at the edge thereof beneath the flexible circuit, a rearward body part having latch means thereon, spring means interposed between the forward and rearward body parts, and positioning means on at least one of the forward and rearward body parts for locating the flexible circuit wrapped about said edge of the forward body part; and an adapter including a first receptacle for receiving the male connector inserted edge first into the first receptacle, and a second receptacle for receiving the second conductors in position for engaging the first conductors of the flexible circuit at the edge of the forward body part of the male body member, the adapter having latch means for engaging the latch means of the rearward body part of the male body member to fix the rearward body part, whereby said spring means biases the forward body part and the first conductors of the flexible circuit against the second conductors.

2. The connector assembly of claim 1 wherein said male body member is elongated and said yieldable backing structure comprises a longitudinal resilient strip along said edge.

3. The connector assembly of claim 1 wherein said positioning means comprises an adhesive between the male body member and the flexible circuit.

4. In combination with the connector assembly of claim 1, a printed circuit board inserted into the second receptacle of the adapter, the printed circuit board having said second conductors engageable with the first conductors of the flexible circuit.

5. In combination with the connector assembly of claim 1, including a second flat flexible circuit inserted into the second receptacle of the adapter, the second flexible circuit having said second conductors engageable with said first conductors.

6. In combination with the connector assembly of claim 1, including a plurality of discrete electrical wires inserted into the second receptacle of the adapter, the discrete electrical wires having said second conductors engageable with the first conductors of the flexible circuit.

7. A connector assembly for removably interconnecting first conductor of a flat flexible circuit to a plurality of second conductors without the use of conductive terminals, comprising;

a male connector including a relatively rigid male body member having an edge about which the flexible circuit is wrapped with the first conductors of the circuit facing away from the body member at the edge thereof;

an adapter including a first receptacle for receiving the male connector inserted edge-first into the first receptacle, and a second receptacle for receiving the second conductors in position for engaging the first conductors of the flexible circuit at the edge of the male body member; and said male body member including a forward body part having said edge about which the flexible circuit is wrapped and a rearward body part latched to the adapter, and spring means between the forward and rearward body parts to bias the forward body part and, thereby, the first conductors of the flexible circuit against the second conductors.

8. A connector assembly for removably interconnecting first conductors of a flat flexible circuit to a plurality of second conductors without the use of conductive terminals, comprising:

a male connector including a relatively rigid male body member having an edge about which the flexible circuit is wrapped with the first conductors of the circuit facing away from the body member at the edge thereof;

an adapter including a first receptacle for receiving the male connector inserted edge-first into the first receptacle, and a second receptacle for receiving the second conductors in position for engaging the first conductors of the flexible circuit at the edge of the male body member; and a printed circuit board inserted into the second receptacle of the adapter, the printed circuit board having said second conductors engageable with the first conductors of the flexible circuit.

9. A connector for interconnecting first conductors of a flat flexible circuit to a plurality of second conductors without the use of conductive terminals, comprising:

a male connector including a relatively rigid male body member having an edge about which the flexible circuit is wrapped with the first conductors of the circuit facing away from the body member at the edge thereof;

a female connecting device including a receptacle for receiving the male connector inserted into the receptacle, and means on the device for positioning said second conductors in engagement with the first conductors of the flexible circuit at the edge of the male body member; and said male body member including a forward body part having said edge about which the flexible circuit is wrapped and a rearward body part latched to the female connecting device, and spring means between the forward and rearward body parts to bias the forward body part and, thereby, the first conductors of the flexible circuit against the second conductors.

10. A connector assembly for interconnecting first conductors of a flat flexible circuit to a plurality of second conductors without the use of conductive terminals, comprising:

a male connector including a relatively rigid male body member having an edge about which the flexible circuit is wrapped with the first conductors of the circuit facing away from the body member at the edge thereof, a female connecting device including a receptacle for receiving the male connector inserted into the receptacle, and means on the device for positioning said second conductors in engagement with the first conductors of the flexible circuit at the edge of the male body member; and a printed circuit board inserted into the receptacle of the female connecting device, the printed circuit board having said second conductors engageable with the first conductors of the flexible circuit.

* * * * *